United States Patent [19]

Allen et al.

[11] Patent Number: 4,778,057

[45] Date of Patent: Oct. 18, 1988

[54] DUAL CLIP TISSUE CARTON

[75] Inventors: E. James Allen, Bramalea; Jack Smid; Rita Panetta, both of Mississauga; Leo C. Sweetnam, Bolton, all of Canada

[73] Assignee: Kimberly-Clark Corporation, Neenah, Wis.

[21] Appl. No.: 109,549

[22] Filed: Oct. 16, 1987

[51] Int. Cl.[4] ..... B65D 75/00

[52] U.S. Cl. ..... 206/602; 206/494; 206/606

[58] Field of Search ..... 206/602, 606, 449, 451, 206/494, 627

[56] References Cited

U.S. PATENT DOCUMENTS

| | | | |
|---|---|---|---|
| 2,197,219 | 4/1940 | Groshong | 206/602 X |
| 2,679,349 | 5/1954 | Mullinix | 206/602 X |
| 2,812,853 | 11/1957 | Cameron | 206/602 X |
| 2,919,844 | 1/1960 | Anderson, Jr. | 206/602 |
| 2,967,610 | 1/1961 | Ebert et al. | 206/602 X |
| 2,975,934 | 3/1961 | Powell | 206/602 X |
| 3,001,644 | 9/1961 | Fourness et al. | 206/449 |
| 3,071,244 | 1/1963 | Doran | 206/602 X |
| 3,090,483 | 5/1963 | Altree et al. | 206/602 X |
| 3,142,378 | 7/1964 | Lengsfield | 206/602 X |
| 3,158,312 | 11/1964 | Simkins | 206/602 |

*Primary Examiner*—Jimmy G. Foster
*Attorney, Agent, or Firm*—Gregory E. Croft

[57] ABSTRACT

A partially open-ended carton contains two clips of interleaved tissues and a centrally located perforated opening means for splitting the carton into two halves. Each half serves to store the unused clip until it is used.

3 Claims, 1 Drawing Sheet

DUAL CLIP TISSUE CARTON

BACKGROUND OF THE INVENTION

In the manufacture of interleaved bath tissues for use in dispensers as are typically found in public restrooms, clips of tissues are individually packaged in clip sizes suitable for most dispensers. However, the carton costs are significant. Therefore, there is a need for reducing carton costs while at the same time providing a sufficient quantity of tissues to fill the dispensers.

SUMMARY OF THE INVENTION

The invention resides in an improved tissue put-up comprising a carton containing at least two individual clips of tissue sheets, said carton having partially open ends and a centrally located perforated opening means which extends substantially around the periphery of the carton. It has been found that this arrangement provides economical use of the carton material and reduces production time because of the dual clip packaging. In addition, the separated carton provides convenient containment for the individual tissue clips until the tissue clips are placed into a dispenser. For purposes herein, reference to "two individual clips of tissue sheets" includes a single double width clip which has been preperforated such that it can be separated into two clips after the carton has been opened.

The tissues within the individual clips are preferably interfolded or interleaved for pop-out type dispensing, but this is dependent upon the design of the dispenser in which the clips are to be used. The nature of the individual tissues can also vary widely depending on the particular end use. For bath tissues, however, tissues having a total basis weight of from about 10 to about 40 grams per square meter are typical.

DETAILED DESCRIPTION OF THE DRAWING

Figure 1:
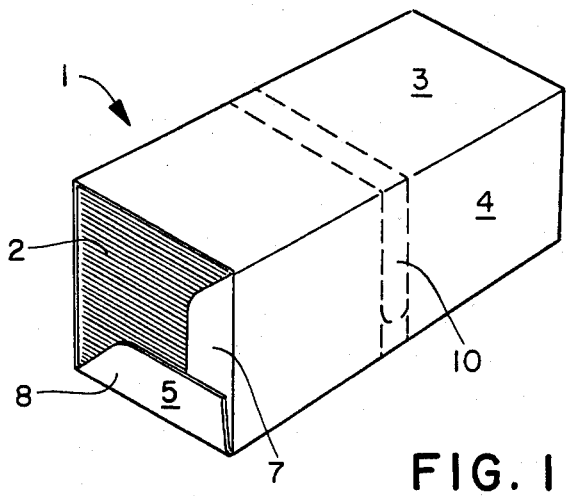
FIG. 1 is a perspective view of a tissue put-up in accordance with this invention.

Referring to FIG. 1, the invention will be described in greater detail. FIG. 1 is a perspective view of a tissue put-up in accordance with this invention. Shown is a carton 1 containing two clips of interfolded bathroom tissues (only one clip 2 is visible in this view). The carton consists of six walls: a top 3, a bottom (not shown), a front 4, a back (not shown), and two partially open ends 5 (one shown). The partially open ends are easily formed by two overlapping flaps 7 and 8 which are adhesively bonded together. The end area occupied by these flaps is less than about 50 percent, but is sufficient to contain the clips of tissue within the carton. Because of the frictional engagement of the individual tissue sheets within the clip, the clip acts as a unit. Hence the amount of open area in the open ends can be substantial. In the particular embodiment illustrated, it is about 56 percent, which is more clearly shown in FIG. 2. Also shown in FIG. 1 is the perforated opening means consisting of a perforated pull strip 10 which is centrally located and extends around the periphery of the carton.

Figure 2A:
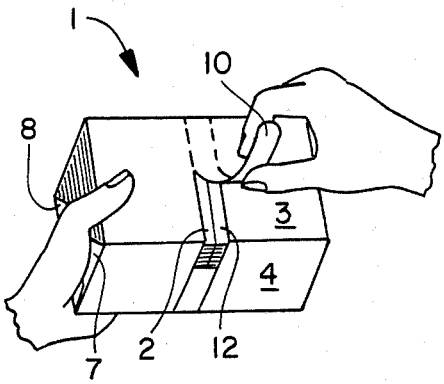
FIGS. 2A and 2B illustrate the opening of the put-up and splitting it into two individual clip containers.
Figure 2B:
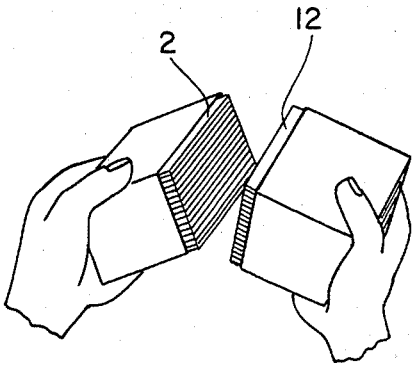

FIGS. 2A and 2B illustrate the manner in which the carton is opened to gain access to the two individual clips 2 and 12. As shown, the pull strip 10 is pulled away completely around the container, thereby creating two independent clip containers. If only one clip is to be used immediately, the other clip is conveniently protected in its own container during temporary storage.

We claim:

1. A tissue put-up comprising a carton containing at least two individual clips of interfolded tissue sheets, said carton having partially open ends comprising only two folded flaps and a centrally located perforated pull strip opening means which extends substantially around the periphery of the carton.

2. The put-up of claim 1 wherein the partially open ends are open about 50 percent or greater.

3. The put-up of claim 2 wherein the partially open ends consist of overlapping flaps adhesively bonded together.

* * * * *